US005779155A

United States Patent [19]

Schennum et al.

[11] Patent Number: 5,779,155

[45] Date of Patent: Jul. 14, 1998

[54] DECOUPLED LIQUID DELIVERY SYSTEM

[75] Inventors: Steven M. Schennum, West Chester; Vernon S. Ping, Cincinnati, both of Ohio

[73] Assignee: The Procter & Gamble Company, Cincinnati, Ohio

[21] Appl. No.: 756,151

[22] Filed: Nov. 26, 1996

[51] Int. Cl.[6] ..... B05B 9/043; B05B 1/30

[52] U.S. Cl. ..... 239/333; 239/578; 239/583

[58] Field of Search ..... 239/99, 333, 526, 239/532, 541, 569, 574, 578, 579, 583; 222/340, 174

[56] References Cited

U.S. PATENT DOCUMENTS

| | | | |
|---|---|---|---|
| 553,999 | 2/1896 | Nicholsburg | 239/574 C |
| 1,497,462 | 6/1924 | Osburn | 239/578 X |
| 2,566,429 | 9/1951 | Schulman | 222/174 X |
| 2,572,540 | 10/1951 | Thompson | 222/2 |
| 5,261,882 | 11/1993 | Sealfon | 604/135 |
| 5,301,852 | 4/1994 | Mancini | 222/321 |
| 5,380,287 | 1/1995 | Kikuchi et al. | 604/135 |
| 5,478,316 | 12/1995 | Bitdinger et al. | 604/135 |

*Primary Examiner*—Lesley D. Morris
*Attorney, Agent, or Firm*—Elizabeth M. Koch

[57] ABSTRACT

A decoupled liquid delivery system positioned within a housing for dispensing a liquid from a liquid filled canister includes a cylinder having an inlet for receiving the liquid and an outlet for dispensing the liquid, a piston moveably engaging the cylinder for exerting pressure on the liquid when the piston is actuated, a compression spring connected to the piston and the housing, and a recoil spring connected to the piston and the housing to prevent the piston from moving prior to actuation. The piston is actuated by disengaging the recoil spring from the piston which allows the compression spring to exert a force on the piston, thereby enabling the piston to exert a pressure on the liquid within the cylinder and dispense the liquid from the outlet.

14 Claims, 5 Drawing Sheets

DECOUPLED LIQUID DELIVERY SYSTEM

FIELD OF THE INVENTION

This invention relates to the field of liquid delivery systems, and more particularly, to a manually actuated, decoupled liquid delivery system for delivering a pre-determined volume of liquid.

BACKGROUND OF THE INVENTION

Conventional manually actuated liquid delivery systems including trigger sprayers and the like, generally deliver a small volume of liquid at a relatively high pressure. These delivery systems typically have a direct relationship between the amount of force or pressure applied to the system and the amount of liquid dispensed at typical trigger or activation rates. In applications where a specific volume and/or pressure of liquid is required, conventional manually actuated systems are incapable of decoupling the pressure/volume (i.e., input/output) relationship. At typical trigger rates more force and subsequently more pressure is required to dispense larger volumes. These sprayers are unable to produce a constant or substantially constant flow rate from user to user based on the variability in the rate of the actuation trigger.

In addition, these conventional trigger actuated liquid delivery systems are incapable of consistently dispensing a specific volume of fluid at a relatively low pressure to a sprayer nozzle while maintaining a pre-determined dispensing distance in front of the nozzle. Also, the specific volume dispensed from a conventional trigger actuated delivery system is usually limited to small volumes. For example, most trigger sprayers dispense approximately 0.5–3 cc of liquid in a single spray but are unable to dispense larger amounts without multiple actuations of the trigger. These systems typically dispense a mist or stream that is difficult to control the flow rate and distance in front of the nozzle.

Therefore, what is needed is a substantially constant flow rate, low pressure, mechanically decoupled, liquid delivery system which delivers a pre-determined volume of liquid at a fixed distance in front of a spray nozzle independent of the actuation rate.

SUMMARY OF THE INVENTION

Accordingly, it is an object of the present invention to provide an improved liquid delivery system.

It is a further object of the present invention to provide a decoupled liquid delivery system positioned within a housing for dispensing a liquid from a liquid filled canister that comprises a cylinder having an inlet for receiving the liquid and an outlet for dispensing the liquid, a piston moveably engaging the cylinder for exerting pressure on the liquid when the piston is actuated, a compression spring connected to the piston and the housing, and a recoil spring connected to the piston and the housing to prevent the piston from moving prior to actuation, wherein the piston is actuated by disengaging the recoil spring from the piston, thereby allowing the compression spring to exert a force on the piston which enables the piston to exert a pressure on the liquid within the cylinder and dispense the liquid from the outlet.

DETAILED DESCRIPTION OF THE INVENTION

Figure 2:
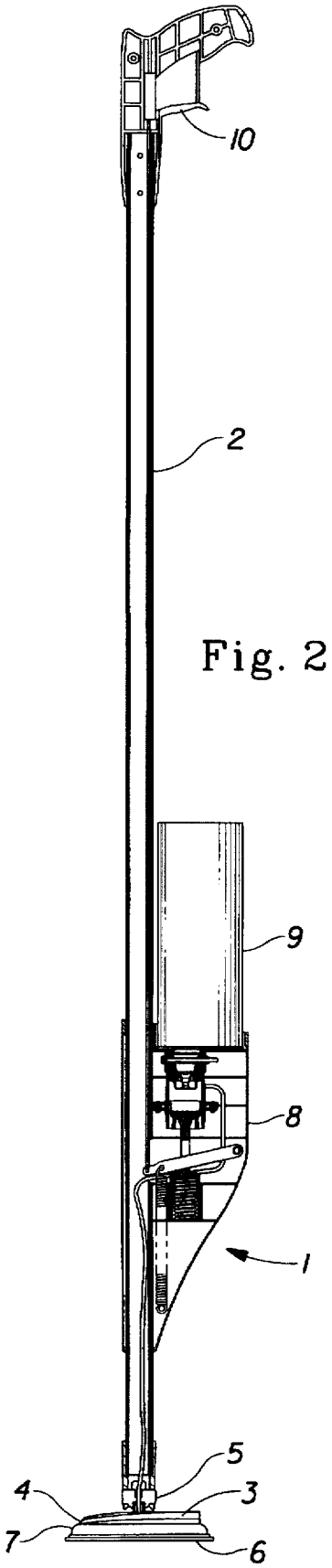
FIG. 2 is a cross sectional view of the cleaning implement which utilizes the preferred liquid delivery system according to the preferred embodiment of the present invention.
Figure 1:
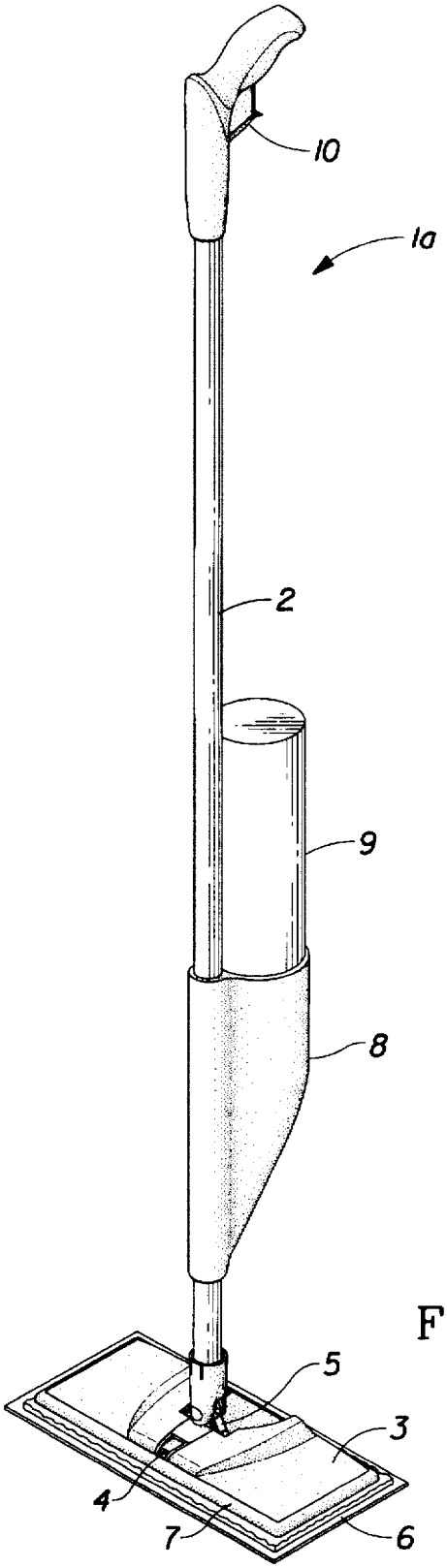
FIG. 1 is a perspective view of a cleaning implement which utilizes the preferred liquid delivery system according to the preferred embodiment of the present invention.

Referring to FIGS. 1 and 2, the preferred liquid delivery system 1 is utilized on a cleaning implement 1*a* but may be utilized on a variety of applications without deviating from the intent of the invention. The cleaning implement 1*a* preferably includes a handle 2, a cleaning head member 3 pivotally attached to the handle 2 by a universal joint 5 and a sprayer nozzle 4 attached to the cleaning head member 3. A cleaning fabric 6 is removably attached to a substantially flat foam bumper pad 7 of the head member 3 preferably by hook fasteners. The preferred liquid delivery system 1 is housed within a housing 8 and supplied by an inverted liquid filled canister 9 upon actuation of the trigger actuator 10.

Figure 3:
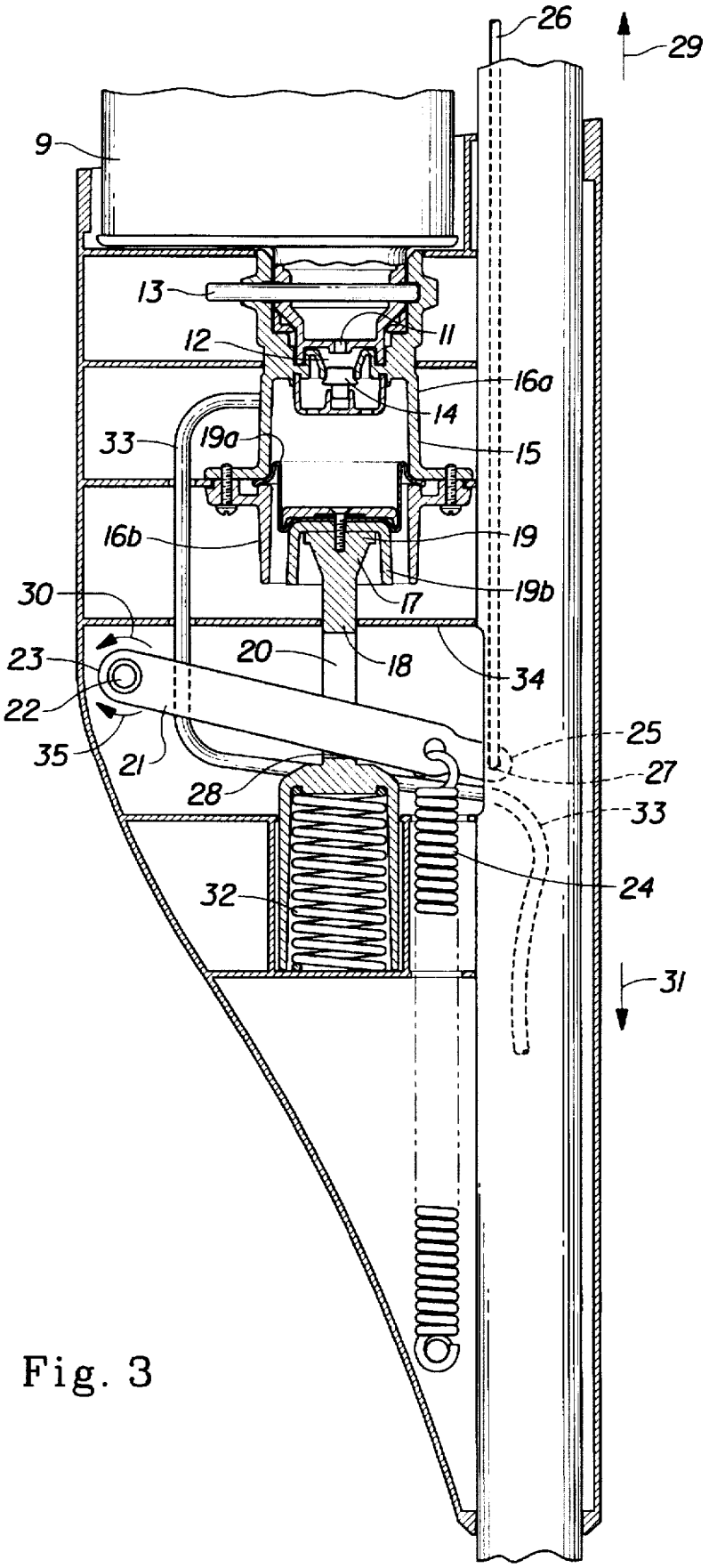
FIG. 3 is a side view of the liquid delivery system at rest according to the preferred embodiment of the present invention.
Figure 4:
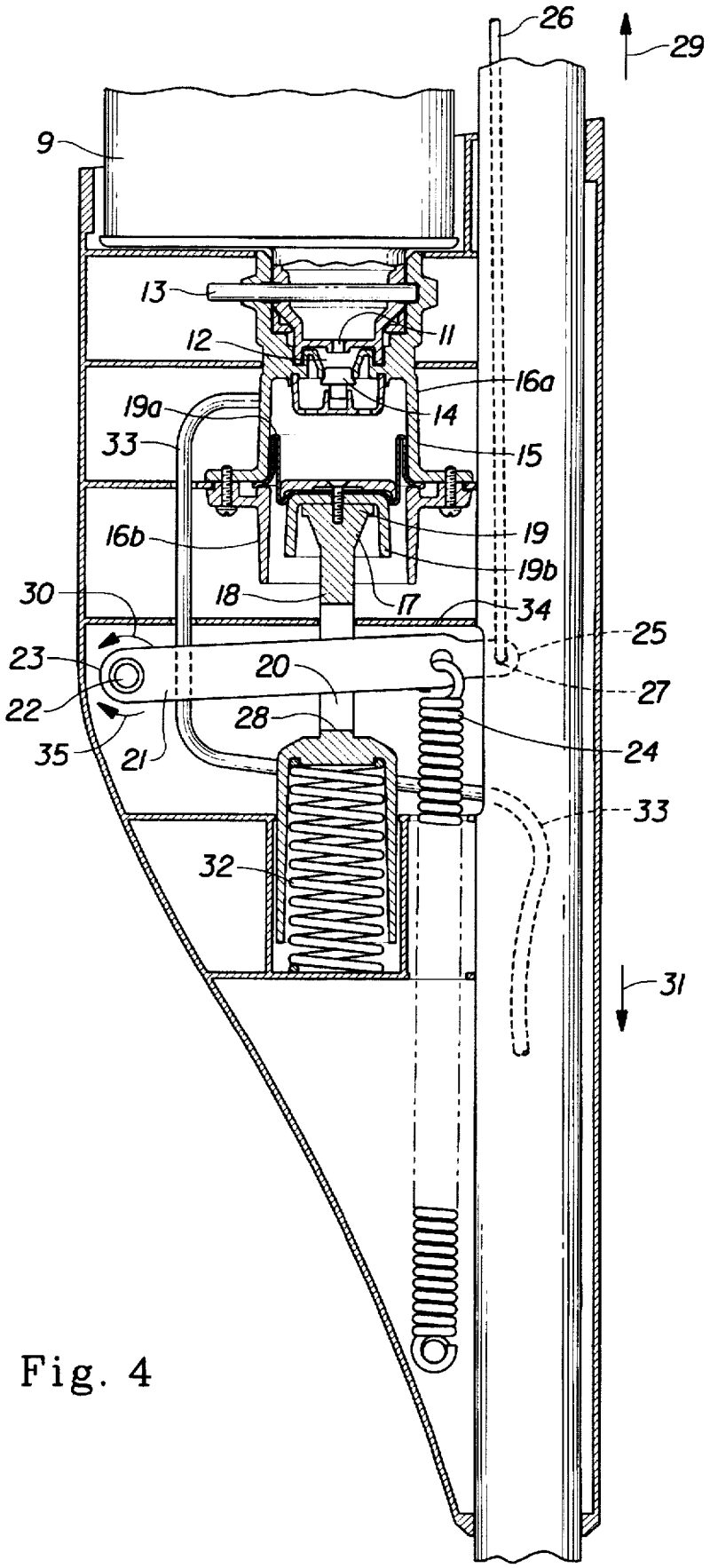
FIG. 4 is a side view of the liquid delivery system when the actuation trigger is fully engaged and the system is at the beginning of the stroke according to the preferred embodiment of the present invention.
Figure 5:
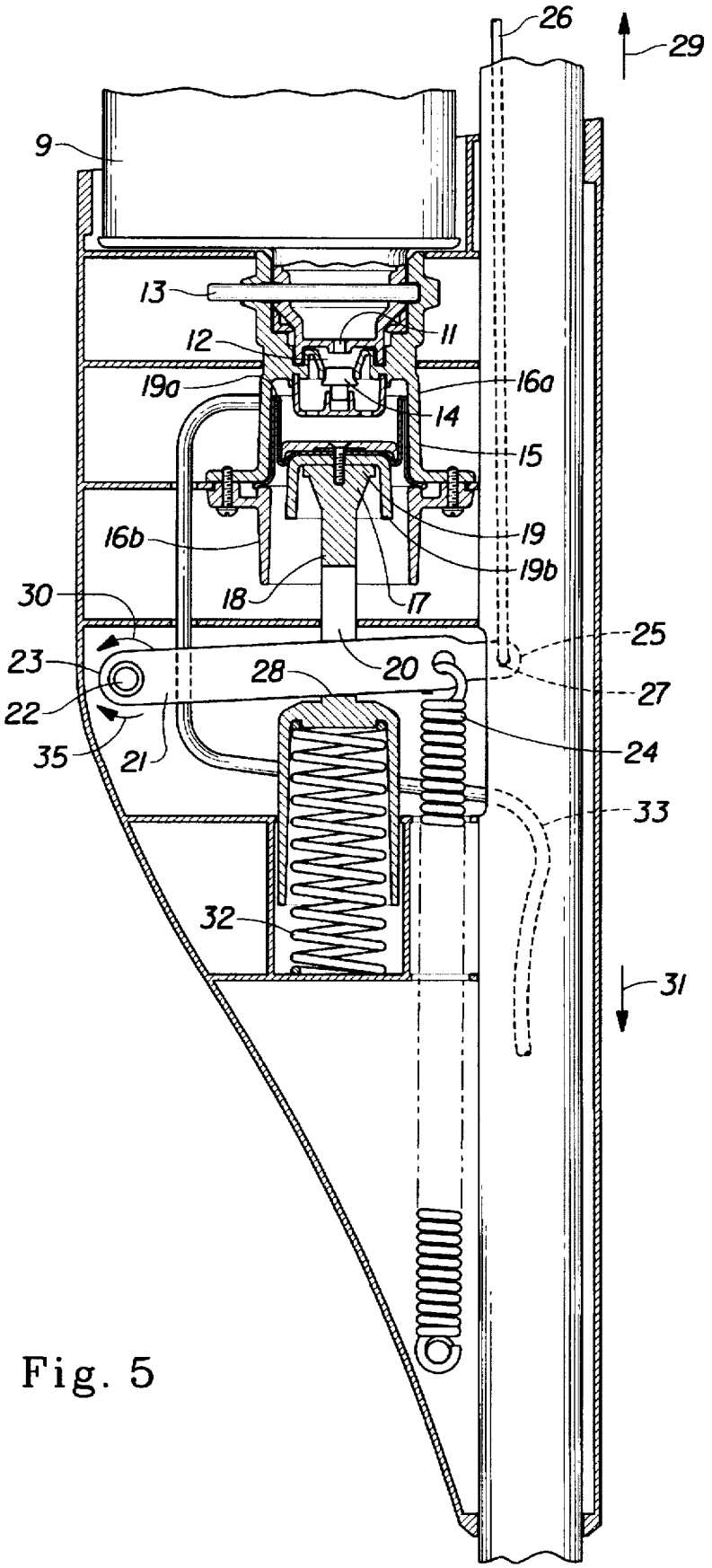
FIG. 5 is a side view of the liquid delivery system when the actuation trigger is fully engaged and the system is at the end of the stroke according to the preferred embodiment of the present invention.

Referring to FIGS. 3–5, the liquid filled canister 9 has an outlet 11 which is inserted within an inlet 12 of a quick disconnect 13 having a safety valve 14 positioned within a cylinder 15 having an upper portion 16*a* and a lower portion 16*b*. Upon insertion of the liquid filled canister 9, the liquid flows from the outlet 11, through the inlet 12 and into the upper portion 16*a*.

Within the cylinder 15 is a piston 17 having a piston actuator 18, a piston head 19, a flexible rolling piston diaphragm 19*a*, a piston cap 19*b* and a slot 20. A lever arm 21 is positioned within the slot 20 and attached to a pivot point 22 at a first end 23 and a recoil spring 24 adjacent a second end 25. A connecting rod 26 is attached between the second end 25 of the lever arm 21 at a joint 27 and the trigger actuator 10. A physical contact point 28 is created between the lever arm 21 and the base of the slot 20 when the liquid delivery system 1 is at rest (FIG. 3).

In operation, the trigger actuator 10 is retracted in a direction 29. Upon actuation, the connecting rod 26, which is also attached to the trigger actuator, moves in the same direction 29 and over the same distance as the trigger actuator 10. Since the connecting rod 26 is attached to the lever arm 21 at the second end 25, the second end 25 also moves in the upward direction 29 as the lever arm 21 rotates in a counter-clockwise direction 30 about the pivot point 22. As the lever arm 21 rotates in a counter-clockwise direction 30, the recoil spring 24 exerts a force in the opposite direction 31 to the trigger actuator 10 force. The recoil spring consists of an extension spring in the preferred embodiment but may include a torsional spring, constant force spring and the like.

As the trigger actuator 10 is actuated, the lever arm 21 disassociates or decouples from the contact point 28. As long as the trigger actuator 10 is held in the retracted position (FIG. 4) and the physical contact between the lever arm 21 and the piston actuator 18 is decoupled, a compression piston spring 32 (FIGS. 4 and 5) forces the piston actuator 18 in the upward direction 29.

A piston guide 34, formed within the housing 8, ensures alignment as the piston moves in the direction 29 in the cylinder 15. As the piston actuator 18 is forced upward 29 by the piston spring 32, the safety valve 14 closes and the fluid within the cylinder 15 is forced out of the cylinder 15 through a tube 33 to the sprayer nozzle 4 at a substantially constant pressure.

During the stroke of the piston actuator 18, the flexible rolling diaphragm 19*a* remains convoluted and rolled in part due to the geometry of the piston cap 19*b*, which results in very low friction within the cylinders 16*a*, 16*b* and free movement of the piston 17. In the preferred embodiment, a flexible rolling diaphragm 19*a* is used. However, the rolling diaphragm can be replaced by a reciprocating o-ring, a pumping diaphragm, a bellows, and the like. The pressure generated within the liquid delivery system 1 due to the piston spring 32 exceeds the cracking or opening pressure of the check valve within the spray nozzle 4 which enables fluid to be dispensed from the sprayer nozzle 4. As the piston actuator 18 translates up into the cylinder 15, the contact point 28 is re-established between the lever arm 21 and the base of the slot 20 in the piston actuator 18 after a time delay, which is a function of the spray nozzle 4 and the rest of the system (FIG. 2). In the preferred embodiment the spray nozzle 4 consists of a low pressure fluidics nozzle that dispenses a fanned uniform spray in front of the cleaning head member 3.

When the external force is removed from the trigger actuator 10 (after a complete upward piston stroke as shown in FIG. 5), the recoil spring 24 exerts a force on the lever arm 21 that causes the lever to rotate in a clockwise direction 35 about the pivot point 22 and return to the steady state or original position (FIG. 3). As the lever arm 21 returns to the original position (FIG. 3), the piston spring 32 is compressed due to the force applied by the recoil spring 24. Upon compression of the piston spring 32, the contact point 28 between lever arm 21 and the bottom of slot 20 exists during the clockwise motion 35 and the rolling diaphragm 19*a* remains rolled or convoluted as the piston 17 moves in the downward direction 31. At this point, negative pressure is developed in the cylinder 15 and liquid from the inverted canister 9 is drawn past the open outlet 11 through the inlet 12 and forces the spring loaded safety valve 14 downward allowing liquid to enter the cylinder 15. In the preferred embodiment canister 9 consists of a collapsible bag in a bottle in order to eliminate the need of venting. The force driving the liquid into the cylinders 16*a*, 16*b* due to the negative pressure exceeds the force exerted by the safety valve 14 that normally drives the safety valve 14 upward against the inlet 12. In the preferred embodiment a safety valve 14 is used. A one-way valve may also be used. As the liquid passes through the safety valve 14, the liquid enters the cylinder 15. Note that the sustained convolution of the rolling piston diaphragm 19*a* during suction can be maintained, assuming that the return rate of the piston actuator 18 in the downward direction 31 does not exceed a maximum negative pressure which is preferable around 2.5 psi.

At steady state (FIG. 3), the force of the recoil spring 24 exerts a downward force on the lever arm 21 that results in the sustained compression of the piston spring 32 and maintains the lever arm 21 in the downward position.

Assuming the actuation rate of the trigger actuator 10 is fast enough to ensure decoupling between the lever arm 21 and piston actuator 18, the rate of the piston actuator 18 is governed by system characteristics. At typical triggering rates, this condition is satisfied and the lever arm 21 lifts freely off the contact point 28. As a result, the dispensing time exceeds the time it takes to move the trigger actuator 10 to the fully retracted position.

If the entire volume of the liquid in the cylinder 15 is dispensed, dispensing stops and the trigger actuator 10 must be released in order to refill the cylinders 16*a* & 16*b* with liquid, assuming liquid remains in the canister 9. It is also possible for the user to release the trigger actuator 10 prior to dispensing of the complete volume of liquid in the cylinders 15, 16 in order to limit the amount dispensed. Upon early release of the trigger actuator 10 prior to complete dispensing, the recoil spring 24 forces the lever arm 21, trigger rod 26, and trigger actuator 10 rapidly in the downward direction 31. As the lever arm 21 rapidly rotates in a clockwise direction 35, it makes contact with the base of the slot 20 in the piston actuator 18, which is moving upward in the direction 29. The recoil spray 24 forces the piston 17 in the downward direction 31 and the piston spring 32 is compressed as the system returns to steady state (FIG. 3). The preferred embodiment of the liquid delivery system can also be applied to other implements. For example, a hand held liquid applicator or pumping system.

Figure 6:
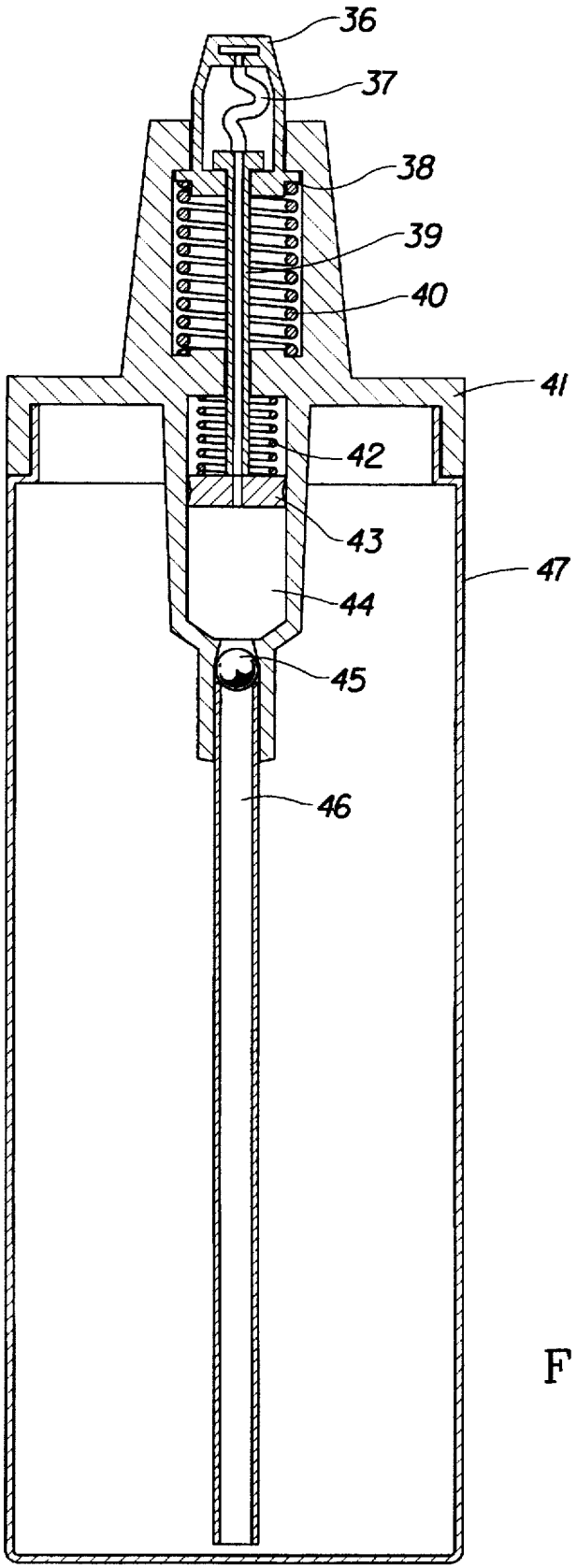
FIG. 6 is a front view of an alternate liquid delivery system according to the present invention.
Figure 6:
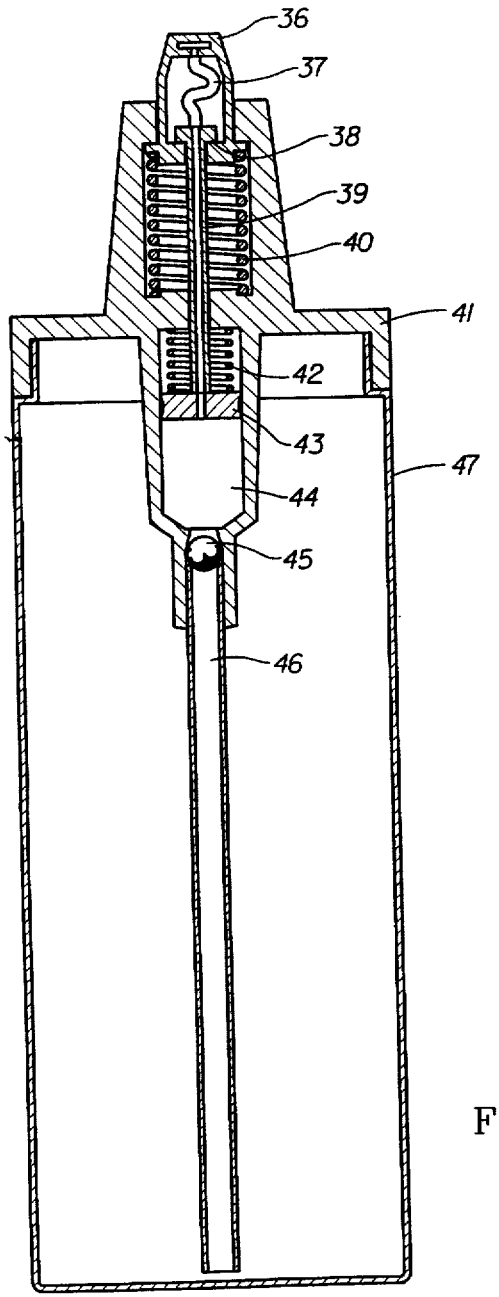

Referring to FIG. 6, a spray nozzle 41 push button 36 is depressed by an external force compressing a recoil spring 40. This causes the spray nozzle 41 push button 36 to separate at contact point 38 from the piston actuator 39. As the spray nozzle 41 push button 36 lifts off the contact point 38, the compression piston spring 42 drives the piston head 43 into the cylinder 44 forcing the fluid out of the cylinder 44 through the piston head 43, hollow piston actuator 39, the flexible connecting tubing 37 and out the spray nozzle 41 push button 36. The pressure created in the cylinder 44 closes the one-way valve 45.

When the external force is removed from the spray nozzle 41 push button 36 the contact point 38 is reestablished between the spray nozzle 41 push button 36 and the piston actuator 39. The recoil spring 40 exerts a force on the spray nozzle 41 push button 36 and actuator 39, driving the piston head 43 upward and compressing the compression piston spring 42. As the piston head 43 moves upward fluid from the fluid reservoir 47 is drawn by suction into the cylinder 44 through the dip tube 46 and the one-way valve 45.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A decoupled liquid delivery system positioned within a housing for dispensing a liquid from a liquid filled canister, comprising:

a cylinder having an inlet for receiving the liquid and an outlet for dispensing the liquid;

a piston moveably engaging said cylinder for exerting pressure on the liquid when said piston is actuated;

a compression spring connected to said piston and the housing; and a recoil spring connected to said piston and the housing to prevent said piston from moving prior to actuation, wherein said piston is actuated by disengaging said recoil spring from said piston, thereby allowing said compression spring to exert a force on said piston which enables said piston to exert a pressure on the liquid within said cylinder and dispense the liquid from said outlet.

2. The liquid delivery system of claim 1, further comprising a lever arm having first and second ends which movably engages a slot within said piston.

3. The liquid delivery system of claim 2, wherein said first end of said lever arm is attached at a pivot point and said recoil spring is attached to said second end of said lever arm.

4. The liquid delivery system of claim 3, wherein a connecting rod is connected between said second end of said lever arm and a trigger actuator.

5. The liquid delivery system of claim 4, wherein said lever arm engages the base of said slot at a contact point when said trigger actuator and the liquid delivery system is at steady state.

6. The liquid delivery system of claim 5, wherein said lever arm disengages and decouples the base of said slot when said trigger actuator is actuated.

7. The liquid delivery system of claim 6, wherein said trigger actuator remains fully retracted until the liquid is substantially dispensed which enables a predetermined volume to be dispensed.

8. The liquid delivery system of claim 6, wherein said compression spring forces said piston into said cylinder when said lever arm is decoupled from said contact point of said slot.

9. The liquid delivery system of claim 8, wherein said piston exerts a substantially constant pressure on the liquid within said cylinder as long as said trigger actuator is actuated sufficiently to prevent said lever arm from engaging said slot at said contact point.

10. The liquid delivery system of claim 9, wherein said piston returns to steady state upon early release of said trigger actuator prior to complete dispensing.

11. The liquid delivery system of claim 9, wherein said outlet is connected to a sprayer nozzle.

12. The liquid delivery system of claim 11, wherein the liquid is dispensed at a substantially constant distance from said sprayer nozzle.

13. The liquid delivery system of claim 11, wherein a substantially constant volume is dispensed from said sprayer nozzle.

14. The liquid delivery system of claim 1, wherein said recoil spring exerts a greater force than said compression spring causing the decoupled liquid delivery system to exist in a steady state.

* * * * *

UNITED STATES PATENT AND TRADEMARK OFFICE

CERTIFICATE OF CORRECTION

PATENT NO. : 5,779,155

DATED : July 14, 1998

INVENTOR(S) : Schennum et al.

It is certified that error appears in the above-identified patent and that said Letters Patent is hereby corrected as shown below:

IN THE DRAWINGS

Sheet 5 of 5, consisting of Figure 6, should be deleted and replaced with the attached Figure 6.

Signed and Sealed this

Nineteenth Day of January, 1999

*Attest:*

*Acting Commissioner of Patents and Trademarks*

*Attesting Officer*

5/5